US006089657A

United States Patent [19]

Banno et al.

[11] Patent Number: 6,089,657

[45] Date of Patent: Jul. 18, 2000

[54] SEAT CUSHION PAD FOR AUTOMOBILES

[75] Inventors: Masanobu Banno; Tsutomu Nakajima; Hiroaki Ono; Junji Yamamoto, all of Osaka, Japan

[73] Assignee: Toyo Tire & Rubber Co., Ltd., Osaka, Japan

[21] Appl. No.: 09/149,960

[22] Filed: Sep. 9, 1998

[30] Foreign Application Priority Data

Sep. 11, 1997 [JP] Japan ..... 9-246512

[51] Int. Cl.[7] ..... A47C 31/00

[52] U.S. Cl. ..... 297/218.1; 297/452.27; 297/DIG. 1

[58] Field of Search ..... 297/452.27, DIG. 1, 297/218.1

[56] References Cited

U.S. PATENT DOCUMENTS

| | | | |
|---|---|---|---|
| 3,612,607 | 10/1971 | Lohr | 297/452.27 |
| 4,072,673 | 2/1978 | Lammers . | |
| 4,522,447 | 6/1985 | Snyder et al. | 297/452.27 |
| 4,726,086 | 2/1988 | McEvoy | 297/DIG. 1 X |
| 4,755,411 | 7/1988 | Wing et al. | 297/452.27 X |
| 4,784,437 | 11/1988 | Shimada | 297/452.27 X |
| 4,795,215 | 1/1989 | Shimada | 297/DIG. 1 X |
| 4,811,439 | 3/1989 | Siegel et al. . | |
| 4,837,881 | 6/1989 | Kondo et al. | 297/452.27 X |
| 4,840,430 | 6/1989 | Shimada | 297/DIG. 1 X |
| 4,865,904 | 9/1989 | Okamura et al. . | |
| 4,871,612 | 10/1989 | Okina et al. . | |
| 4,876,805 | 10/1989 | Peoples . | |
| 4,951,334 | 8/1990 | Maier | 297/452.27 X |
| 5,039,158 | 8/1991 | Maier . | |
| 5,085,487 | 2/1992 | Weingartner et al. | 297/452.27 X |
| 5,269,590 | 12/1993 | Carilli | 297/DIG. 1 X |
| 5,294,181 | 3/1994 | Rose et al. | 297/452.27 X |
| 5,425,567 | 6/1995 | Albecker, III . | |
| 5,439,270 | 8/1995 | Owen | 297/452.27 |
| 5,442,823 | 8/1995 | Siekman et al. | 297/452.27 X |
| 5,499,413 | 3/1996 | Van Hekken | 297/452.27 X |
| 5,542,747 | 8/1996 | Burchi | 297/DIG. 1 X |
| 5,564,144 | 10/1996 | Weingartner et al. | 297/452.27 X |
| 5,632,053 | 5/1997 | Weingartner et al. | 297/452.27 X |
| 5,850,645 | 12/1998 | Ogawa | 297/452.27 X |
| 5,855,415 | 1/1999 | Lilley, Jr. | 297/452.27 |

*Primary Examiner*—Peter M. Cuomo
*Assistant Examiner*—Rodney B. White
*Attorney, Agent, or Firm*—Jordan and Hamburg LLP

[57] ABSTRACT

A seat cushion pad for automobiles, wherein at least a part of the seat surface portion comprises a high-resilience foam. The foam is selected such that a load ratio (3%ISR) between a load at which the thickness is 25% compressed when pressed with a pressure plate having a diameter of 60 mm (25%-strain load) and a load at which the thickness is 3% compressed when pressed with the same pressure plate (3%-strain load) is at least about 6. Alternatively, another ratio (5%ISR) between the load at which the thickness is 25% compressed when pressed with the above dimensioned pressure plate (25%-strain load) and a load at which the thickness is 5% compressed when pressed with the pressure plate (5%-strain load) is selected to be at least about 4. Such design provides comfortable seating and resistance against fatigue even during periods of extended driving, and can be prepared at a low cost with a large degree of design freedom.

8 Claims, 8 Drawing Sheets

SEAT CUSHION PAD FOR AUTOMOBILES

BACKGROUND OF THE INVENTION

The present invention relates to a seat cushion pad for automobiles.

A conventional seat cushion pad for automobiles made up of a polyurethane foam, etc. (hereinafter referred to simply as "cushion pad"), has a general tendency of being too soft. Initially, the cushion pad is comfortable to sit on, but because of the large upwardly directed and shaking forces encountered particularly during long-term driving, a numbness in the legs and pronounced fatigue are liable to occur, which have heretofore presented a problem.

To solve the above-stated problems, a cushion pad obtained by forming a slab layer having a thickness of from about 15 to 20 mm on the surface of a high-resilience foam by adhesion has been used. According to such a cushion pad, because the surface is soft, and the inside thereof has an elasticity to some extent, the cushion pad provides the benefit that it is comfortable to sit on, and even during long periods of driving, does not induce a tired feeling in the occupant of the vehicle.

However, a problem associated with such a cushion pad of a double layer structure is that an additional process of adhering is required in the production thereof, whereby the cost is increased, and also the freedom for design is sharply restricted.

The present invention has been made in view of the above-described circumstances, and an object of the present invention is to provide a cushion pad which is comfortable to sit on because the surface thereof gives a soft feeling, reduces the occurrence of a tired feeling even during long periods of driving, can be produced at a low cost by obviating a double layer structure, and permits a large freedom of design.

SUMMARY OF THE INVENTION

In accordance with this and other objects of the invention, a seat cushion pad for automobiles is provided, wherein at least a part of the seat surface portion comprises a high-resilience foam, and a "3%ISR" value calculated by following equation (1) using a "25%-strain load" and a "3%-strain load" measured in the above-described seat surface portion is at least about 6.

$$(3\%ISR)=(25\%\text{-strain load})/(3\%\text{-strain load}) \quad (1)$$

In the above equation, the term "25%-strain load" is a load at which the thickness is 25% compressed when pressed by a pressure plate having a diameter of 60 mm, and the term "3%-strain load" is a load at which the thickness is 3% compressed when pressed by the above-described pressure plate.

In a seat cushion pad for automobiles in accordance with another embodiment, at least a part of the seat surface portion comprises a high-resilience foam, and a "5%ISR" value calculated by the following equation (2) using a "25%-strain load" and a "5%-strain load" measured in the above-described seat surface portion is at least about 4.

$$(5\%ISR)=(25\%\text{-strain load})/(5\%\text{-strain load}) \quad (2)$$

In the above equation, the term "25%-strain load" is a load at which the thickness is 25% compressed when pressed by a pressure plate having a diameter of 60 mm, and the term "5%-strain load" is a load at which the thickness is 5% compressed when pressed by the above-described pressure plate.

In the seat cushion pad for automobiles in accordance with either of the above-mentioned embodiments, the high-resilience foam is advantageously a polyurethane foam prepared with an isocyanate containing diphenylmethane diisocyanate as a main constituent . It is also deemed advantageous that the high-resilience foam is a polyurethane foam prepared with an isocyanate containing diphenylmethane diisocyanate as a main constituent and containing tolylene diisocyanate in a ratio of less than 10%

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
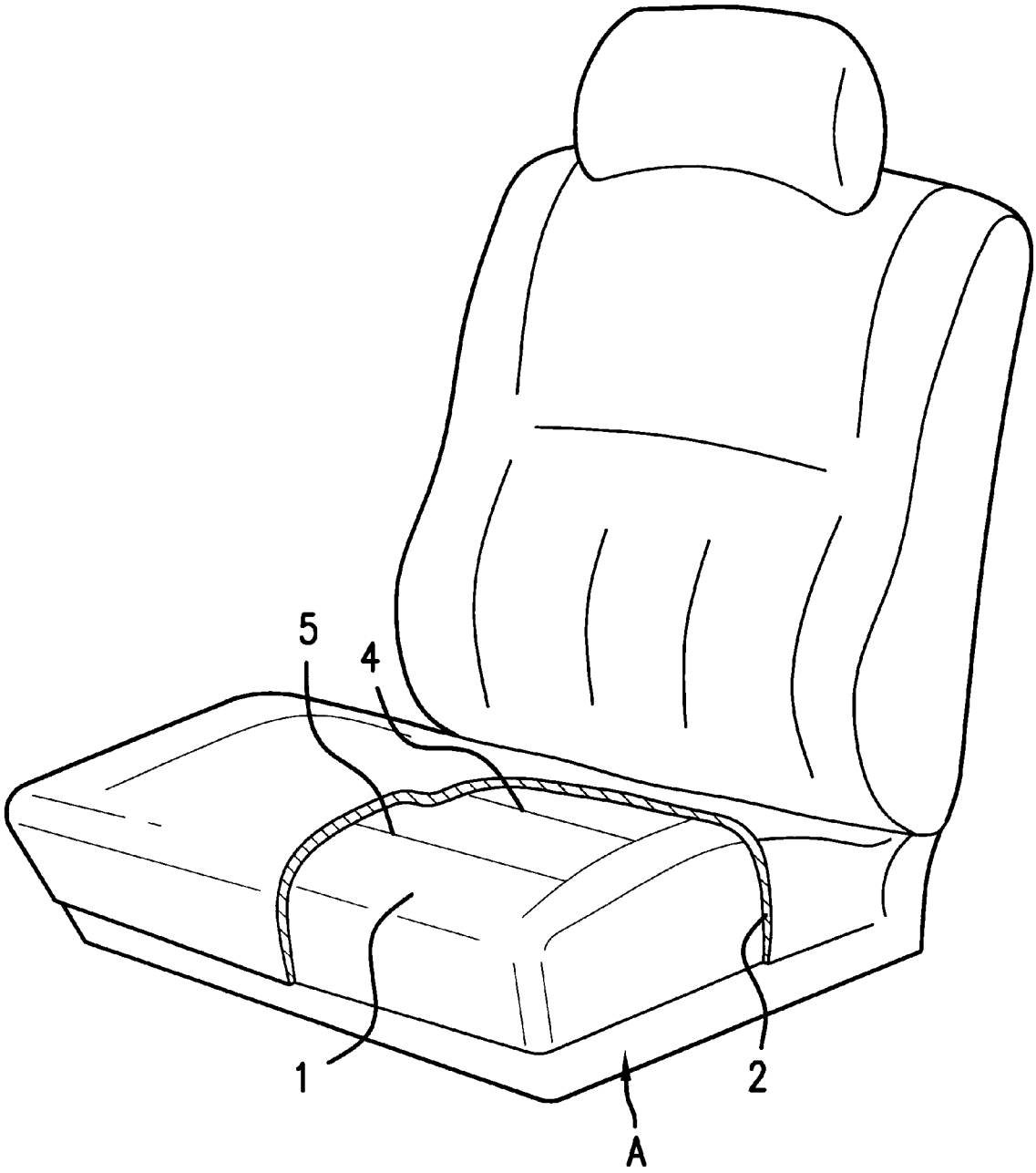
FIG. 1 is a perspective view showing an example of a seat for automobiles to which the cushion pad of the present invention is applied.

A cushion pad A of the present invention constitutes a front seat or a rear seat for automobiles as shown, for example, in FIG. 1, and a part or the whole of a seat surface portion 1 is comprised of a high-resilience foam. The high-resilience foam in the present invention means a high-elasticity foam, i.e. a foam having a core impact resilience of at least 50%. The core impact resilience is measured by the following method.

A test piece of 30 mm in thickness is sampled from a core portion of a foam, pre-pressed by a palm pressure to a distance of about 75% of the thickness of the test piece 10 times. The test piece is then allowed to stand for at least 1 minute. Then, the test piece is placed on a horizontal stand, and a rigid ball (diameter: about 16 mm, weight: 16.29 g) is released and allowed to free-fall onto the test piece from a distance of 460 mm above the test piece, and a maximum impacted perpendicular distance $D_1$ at the case is measured. From the following equation (3), the impact resilience R (%) is calculated.

$$R=(D_1/D_0)\times 100$$

($D_0$ is a free fallen distance of the rigid ball (mm), and $D_1$ is a maximum impacted perpendicular distance (mm).)

In addition, in FIG. 1, reference numeral 2 shows an outer cover comprised of a synthetic resin-made sheet, etc., and numerals 4 and 5 are hanging grooves provided on the seat surface portion 1.

Also, in the seat cushion pad for automobiles of the present invention, the seat surface portion 1 is pressed by a pressure plate having a diameter of 60 mm, and the 3%ISR value calculated by the above-described equation (1) is at least about 6, or the 5%ISR value calculated by the above-described equation (2) is at least about 4.

By establishing the 3%ISR value or the 5%ISR value in the above-described range, a cushion pad is obtained which is comfortable to sit on, because the surface thereof gives a soft feeling and the occurrence of numbness and a tired feeling on the part of the occupant is sharply reduced even during long periods of driving.

It is considered that reduction in the occurrence of numbness and a tired feeling are achieved by virtue of the following reasons.

Firstly, in a conventional cushion pad, a car driver or passenger is exposed to a strong pressure over a wide range extending from the buttocks to the thigh, but according to the cushion pad of the present invention, the center of gravity is applied to a narrow range under the ischial tuberosity, and a strong pressure over a wide range does not occur.

Secondly, in a conventional cushion pad, because the decay is slow, and the resonance magnification is high, the upwardly directed forces and the feeling of shaking are large, and thus, as the result of the body's attempts to maintain a normal position, physical strength is exhausted and the car driver or passenger is liable to experience fatigue. However, according to the cushion pad of the present invention, because the decay is fast, and the resonance magnification is low, the problems in the conventional products described above do not occur, and therefore excessive exhaust of physical strength does not occur.

A polyurethane foam synthesized from an isocyanate and an active hydrogen compound such as polyol, water, etc., can be suitably used for the high-resilience foam constituting the cushion pad of the present invention.

It is preferred that the isocyanate mainly consists of MDI (4,4 diphenylmethane diisocyanate, 2,4 diphenylmethane diisocyanate, or 2,2 diphenylmethane diisocyanate), but the isocyanate can contain TDI (tolylene diisocyanate) in an amount of less than 10% to the total isocyanate component. In addition, the MDI, as referred to in the present specification, includes both of pure (monomeric) MDI and crude (polymeric) MDI.

There is no particular restriction on the kind of the polyol, and, for example, EP3028, EP3033, EP828, POP3128, POP3428, POP3628 (made by Mitsui Chemicals, Inc.), etc., can be used.

Other components, in addition to the above-described components, which are usually used at the production of the polyurethane foam, and there are no restrictions on the kinds of such components. These may include, for example, a crosslinking agent, a foam controlling agent, a catalyst, etc.

Examples of the crosslinking agent include triethanolamine, diethanolamine, etc. Examples of the foam controlling agent include SF-2962, SRX-274C, 2969T (made by Dow Corning Toray Silicone Co., Ltd.), etc. Also, examples of the catalyst include Dabco 33LV (made by Mitsui Air Product Co.), Toyocat ET, SPF2, MR (made by TOSOH CORPORATION), etc.

Furthermore, if necessary, other additives such as water, a toner, a flame retardant, etc., can be properly used.

Examples of the flame retardant include CR530, CR505 (made by Daihachi Chemical Industry Co., Ltd.), etc.

There is no particular restriction on the production method of the cushion pad of the present invention, and for example, the cushion pad can be easily obtained by mixing the above-described components at definite ratios, and, after uniformly mixing them, charging the mixture in a mold followed by foaming and curing.

In addition, in case of charging the mixture in the mold, an auxiliary material such as a back surface-reinforcing material, etc., may be previously set to the mold, and the mixture may be molded in a body with such an auxiliary material. There is no particular restriction on the back surface-reinforcing material, but a polypropylene-made net, etc., can be suitably used.

EXAMPLES

The present invention is described in more detail with reference to the following Examples, however, the present invention is not limited to these Examples.

1. Production of Cushion Pad

The components shown in Table 1 below were mixed at the ratios described in the table, and after uniformly mixing, the mixture was charged in a mold, followed by foaming and curing to obtain a molded product having side surface forms shown in FIG. 2 and FIG. 3. In this particular case, a back surface-supporting material was previously set in the mold, and the mixture was molded in a body with the back surface-supporting material. As the back surface-supporting material, a polypropylene-made net (Nisseki Conwed Net, made by Nisseki Goju Seihin K. K.) was used in Example 1 and Comparative Example 1, respectively, and urethane fibers (Espansione, made by Kanebo, Ltd.) were used in Example 2 and Comparative Example 2, respectively.

Figure 2:
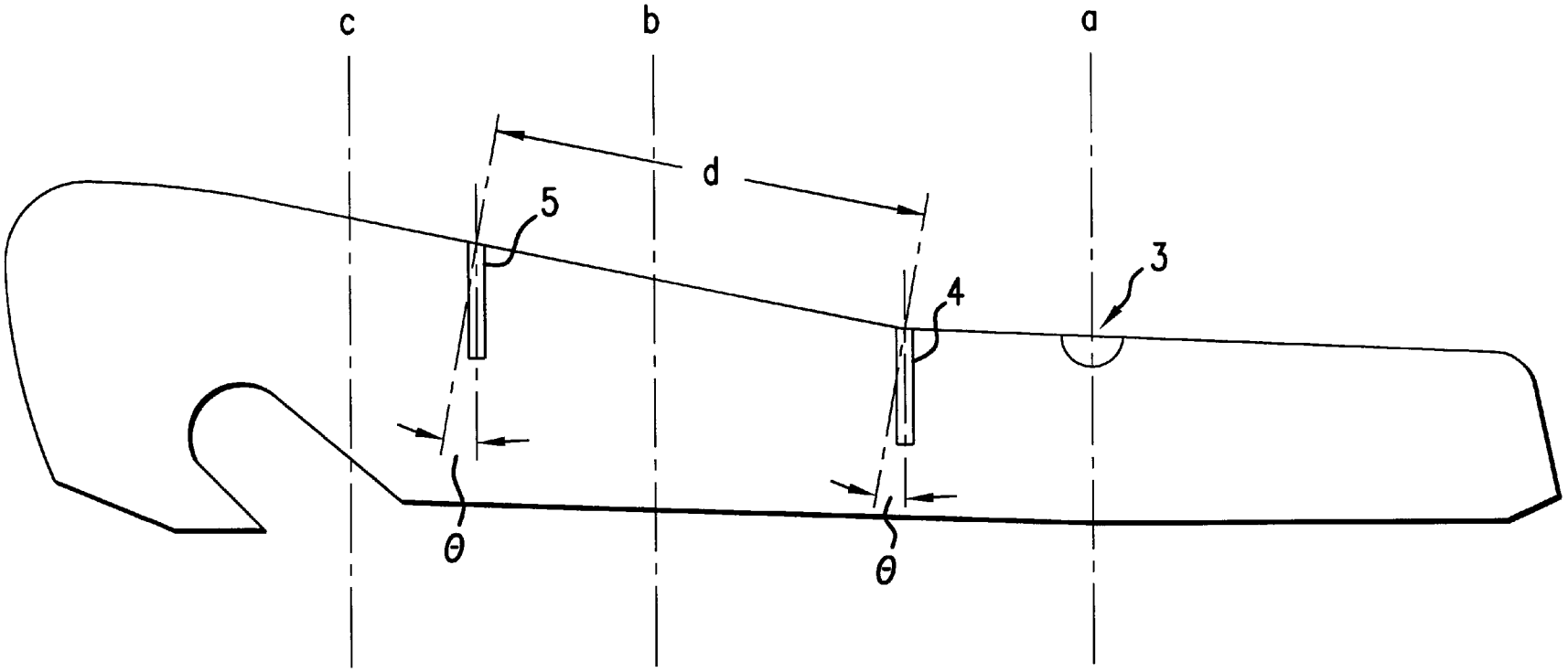
FIG. 2 is a longitudinal end view in the center line of the cushion pads produced in the Examples and the Comparative Examples.
Figure 3A:
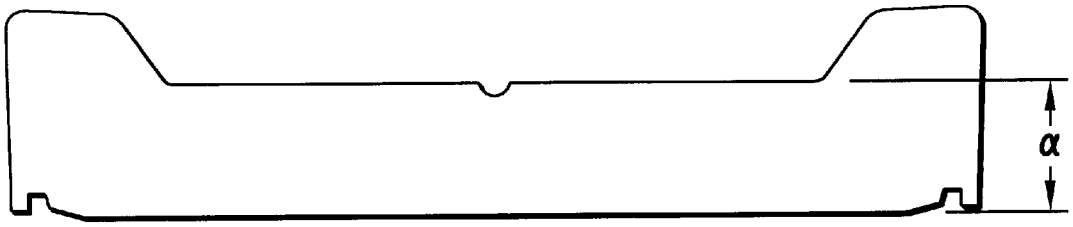
FIG. 3 is an lateral side view cut along each of line a, line b, and line c in FIG. 2.
Figure 3B:
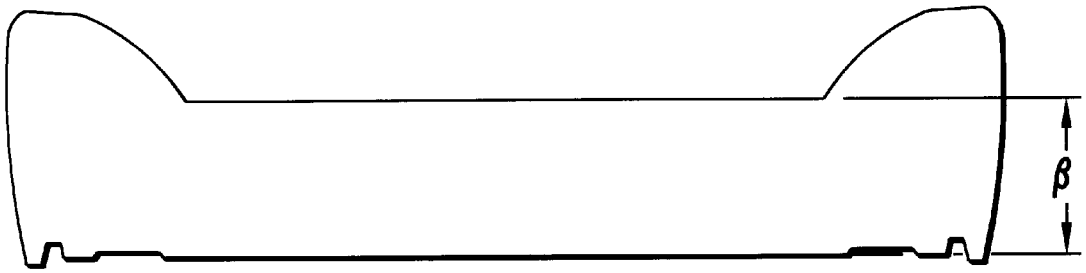
Figure 3C:
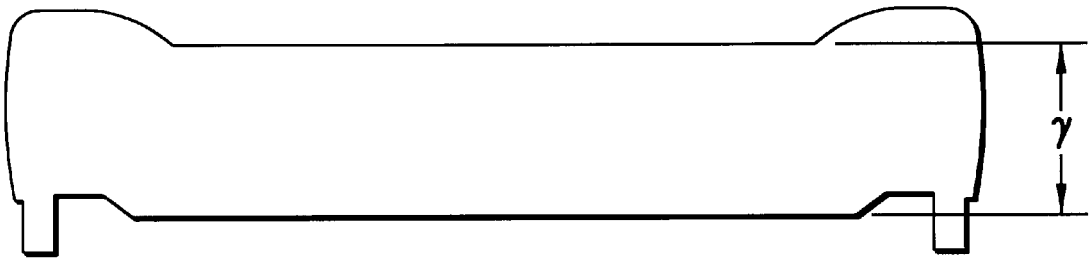

In addition, FIG. 2 is a side surface view in the center line of the cushion pad and FIGS. 3(*a*) to (*c*) are side surface views cut along the line a to the line c, respectively in FIG. 2. The line a is the line passing a hip point, and a depression 3 having a diameter of about 15 mm is provided.

In FIG. 2, the hanging grooves shown by numerals 4 and 5 are each formed in the lateral direction of the cushion seat and formed to the gravity direction at fitted-state of the cushion seat. Also, the angles θ formed by the grooves and the vertical line from the surface of the cushion seat are 12.6°, respectively. Also, the depth of each hanging groove is 40 mm and the distance d between the two hanging grooves is 148 mm.

Also, in FIG. 3, the dimensions of α, β, and γ are α=65 mm, β=80 mm, and γ=40 mm, respectively. Furthermore, the distance between the line a and line b is 150 mm, and the distance between the line b and line c is 100 mm.

TABLE 1

| | | | Examples | Comparative Examples |
|---|---|---|---|---|
| Isocyanate | C—MDI | *1 | 90 | 20 |
| | TDI-80 | *2 | 10 | 80 |
| Polyol | PPG-A | *3 | 80 | 80 |
| | POP-B | *4 | 20 | 20 |

TABLE 1-continued

| | | | Examples | Comparative Examples |
|---|---|---|---|---|
| Crosslinking agent | | *5 | 2.0 | 2.0 |
| Water | | | 3.0 | 3.0 |
| Foam Controlling agent | | *6 | 1.0 | 1.0 |
| Catalyst | A | *7 | 0.5 | 0.5 |
| | B | *8 | 0.2 | 0.2 |

*1: Crude MDI (mixture of 2,4 MDI and 4,4 MDI)
*2: TDI modified with PPG (molecular weight: 5,000)
*3: EP-3028 (made by Mitsui Chemicals, Inc.)
*4: POP-3128 (made by Mitsui Chemicals, Inc.)
*5: Diethanolamine
*6: SF-2962 (made by Dow Corning Toray Silicone Co., Ltd.)
*7: Dabco 33LV (made by Sankyo Air Products Co.)
*8: Toyocat ET (made by TOSOH CORPORATION)

2. Measurement of 3%ISR Value and 5%ISR Value

The 3%ISR value and the 5%ISR value in the seat surface portion of the molded product as obtained above were measured in the seat surface portion between the line a and the line c in FIG. 2, which was a flat portion where no hanging groove was provided.

The measurement was carried out by an autograph, manufactured by Shimadzu Corporation, using a disk having a diameter of 60 mm at a cross head speed of 100 mm/minute.

The results are shown in Table 2 together with the inifial thickness of the measured site.

TABLE 2

| | Example 1 | Comparative Example 1 | Example 2 | Comparative Example 2 |
|---|---|---|---|---|
| Back surface Support member | PP-made net *1 | | Polyurethane fiber *2 | |
| Initial thickness (mm) | 70.8 | 68.6 | 69.3 | 69.6 |
| 3% Strain load (N) | 4.84 | 6.62 | 5.44 | 7.91 |
| 5% Strain load (N) | 7.75 | 10.43 | 8.25 | 10.33 |
| 25% Strain load (N) | 36.5 | 35.4 | 35.7 | 35.8 |
| 3% ISR value | 7.54 | 5.21 | 6.56 | 4.53 |
| 5% ISR value | 4.71 | 3.31 | 4.33 | 3.47 |

*1: Nisseki Conwed Net (a registered trade name, made by Nisseki Goju Seihin K.K.)
*2: Espanaione (a registered trade name, made by Kanebo, Ltd.)

As shown in Table 2, in the cushion pads of Examples 1 and 2, the 3%ISR value is about 6 or higher, and the 5%ISR value is about 4 or higher, but the cushion pads of Comparative Examples 1 and 2 do not satisfy these standards.

In addition, from these results, it can be seen that in the cushion pad of the present invention, both the hard material, such as the polypropylene-made net used in Example 1, and the soft material, such as urethane fibers, used in Example 2 can be used, but when using the hard material, the features of the present invention appear more remarkably.

3. Measurement of Load-Bending Curve

The load-bending curve in the seat surface portion of each of the cushion pads obtained in Example 1 and Comparative Example 1 was measured using the line a (hip point) of FIG. 2 as the center. The initial thickness of the measured site was 64.2 mm in the sample obtained in Example 1 and 66.1 mm in the sample of Comparative Example 1, respectively.

The measurement was carried out by an autograph, manufactured by Shimadzu Corporation, using a disk having a diameter of 200 mm at a cross head speed of 100 mm/minute.

Figure 4:
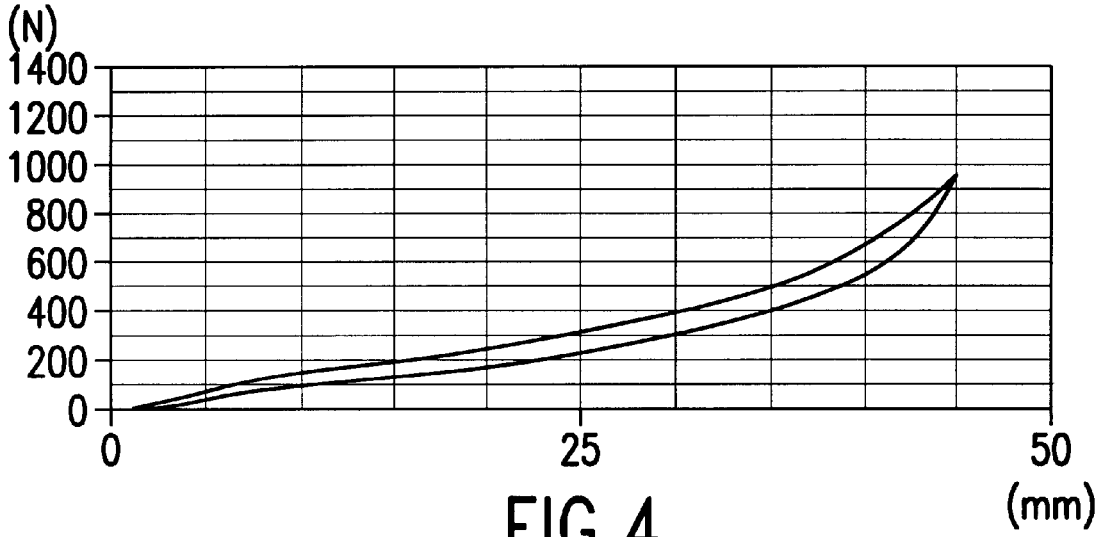
FIG. 4 is a graphical representation showing the load-bending curve of the cushion pad of Example 1.
Figure 5:
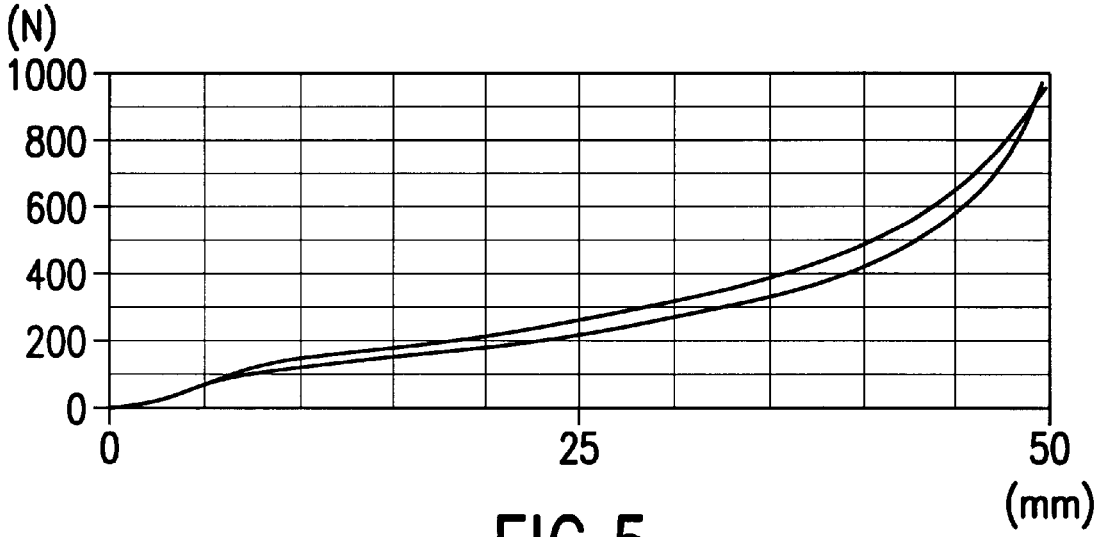
FIG. 5 is a graphical representation showing the load-bending curve of the cushion pad of Comparative Example 1.

The results are shown in FIG. 4 and FIG. 5.

From the results, it can be seen that in the cushion pad of Example 1, the surface is soft, and the pushing up feeling while driving is small (fitting feeling is large) as compared with the cushion pad of Comparative Example 1.

4. Measurement of Body Pressure Distribution

A pressure-sensor seat (BIG-MAT 2000, a trade name made by NRITA CORPORATION) was placed on each of the cushion pads obtained in Example 1 and Comparative Example 1. A panelist having a height of 175 cm and a weight of 65 kg sat on the seat, and body pressure distribution was measured.

Figure 6:
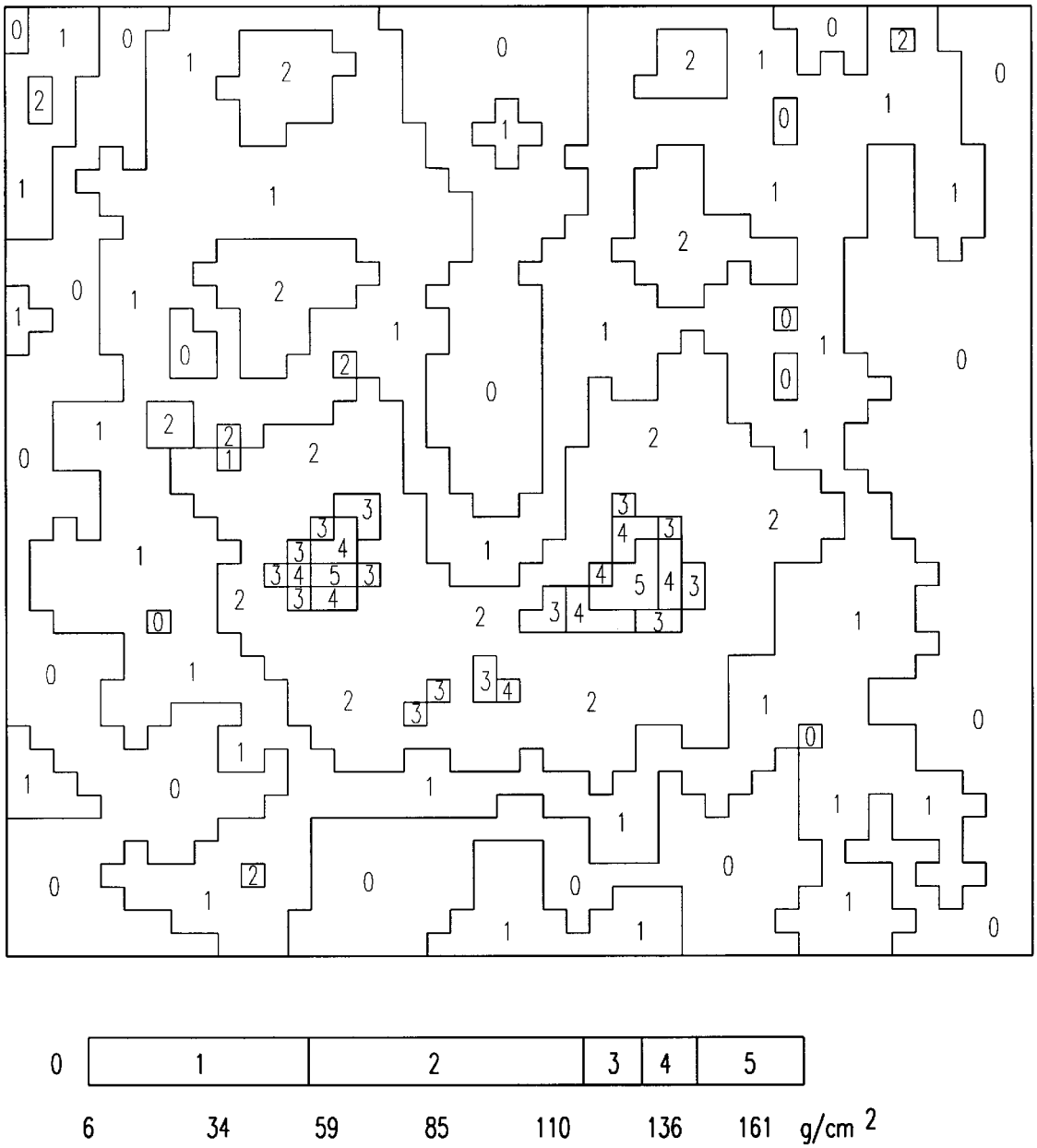
FIG. 6 is a schematic view showing the body pressure distribution of the cushion pad of Example 1.
Figure 7:
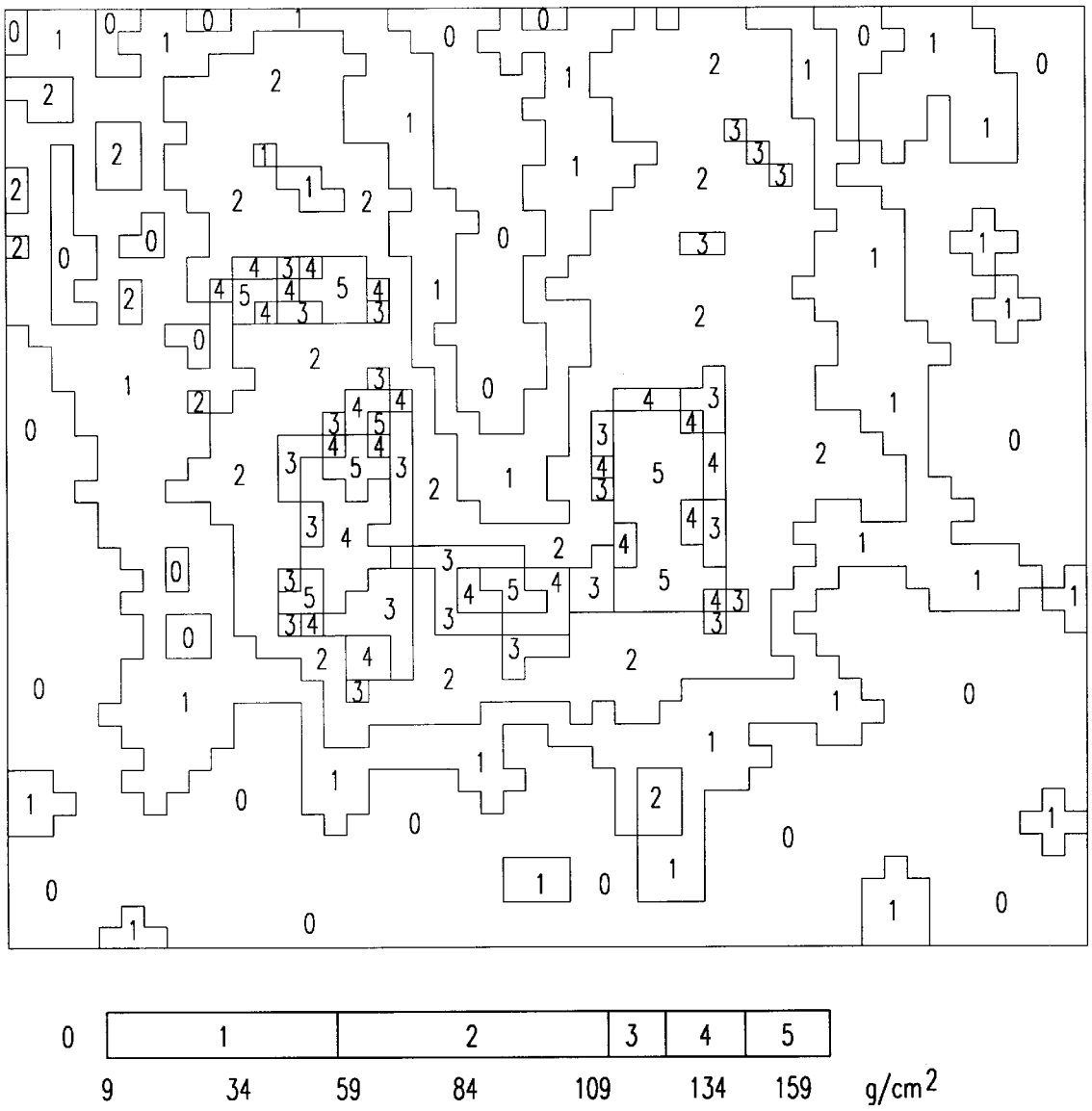
FIG. 7 is a schematic view showing the body pressure distribution of Comparative Example 1.

The results are shown in FIG. 6 and FIG. 7. The evaluation points 1 to 5 in the figures shows that a larger value represents a higher pressure.

In more detail, FIG. 6 shows that in the range of the evaluation point 1, the pressures of the minimum value of about 6 (unit was g/cm$^2$, hereinafter the same), the maximum value of about 59 and the median value of about 34 were perceived; in the range of the evaluation point 2, the pressures of the minimum value of about 59, the maximum value of about 110, and the median value of about 85 were perceived; in the range of the evaluation point 3, the pressures of the minimum value of about 110 and the maximum value of about 136 were perceived; in the range of the evaluation point 4, the pressure of the median value of about 136 was perceived; and in the range of the evaluation point 5, the pressure of the median value of about 161 was perceived.

Also, FIG. 7 shows that in the range of the evaluation point 1, the pressures of the minimum value of about 9, the maximum value of about 59 and the median value of about 34 were perceived; in the range of the evaluation point 2, the pressures of the minimum value of about 59, the maximum value of about 109 and the median value of about 84 were perceived; in the range of the evaluation point 3, the pressures of the minimum value of about 109, and the maximum value of about 134 were perceived; in the range of the evaluation point 4, the pressure of the median value of about 134 was perceived; and in the range of the evaluation point 5, the pressure of the median value of about 159 was perceived.

From these results, it can be seen that in the case of the cushion pad of Comparative Example 1, the panelist was strongly pressed in a wide range of from the buttocks to the thigh, but in case of the cushion pad of Example 1, the center of gravity was applied to a narrow portion under the ischial tuberosity and the strong pressure over the wide range, as in the case of using the cushion pad of Comparative Example 1, did not occur.

5. Vibration Test

Figure 8:
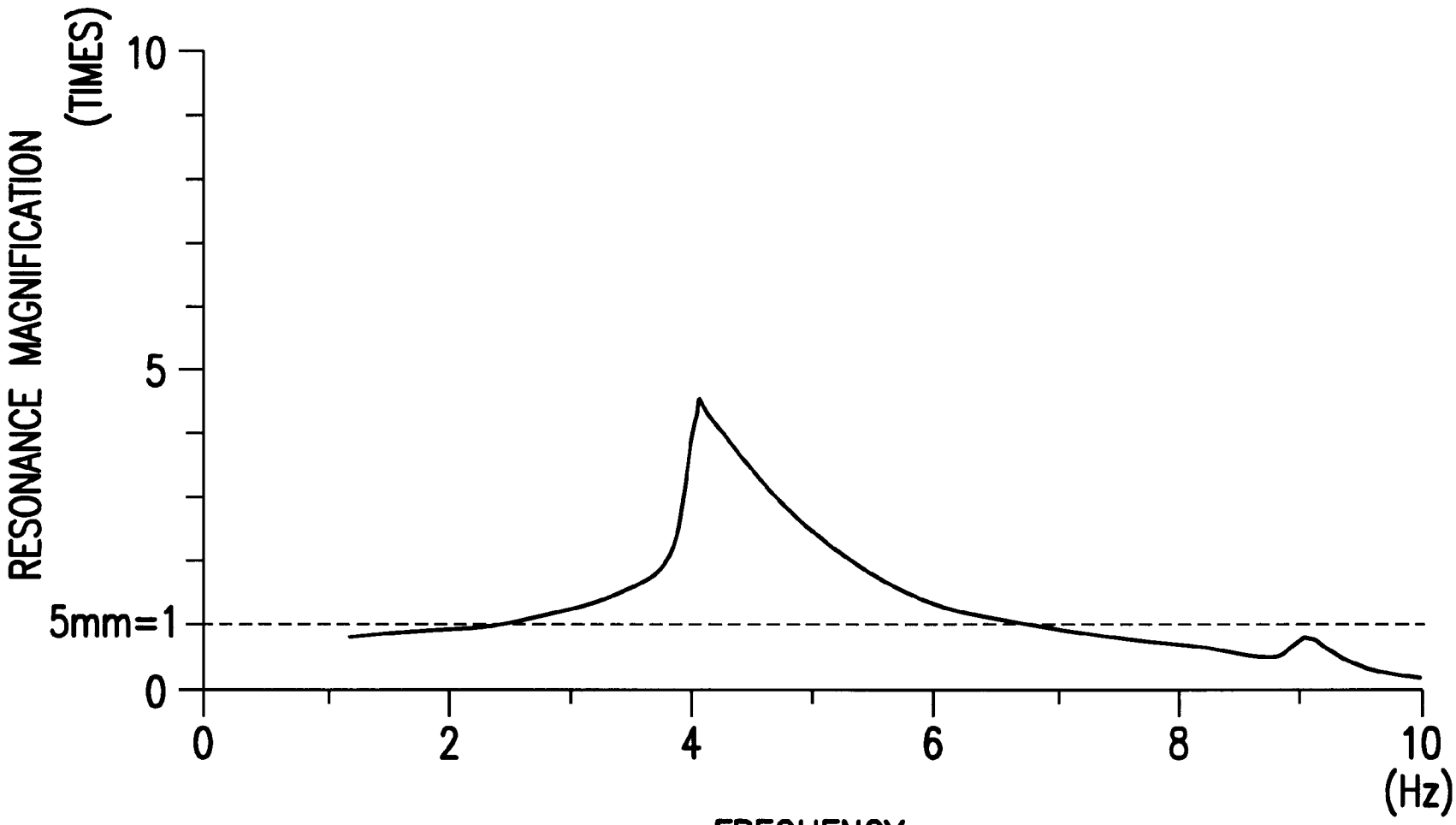
FIG. 8 is a graphical representation showing the result of the vibration characteristics test of the cushion pad of Example 1.
Figure 9:
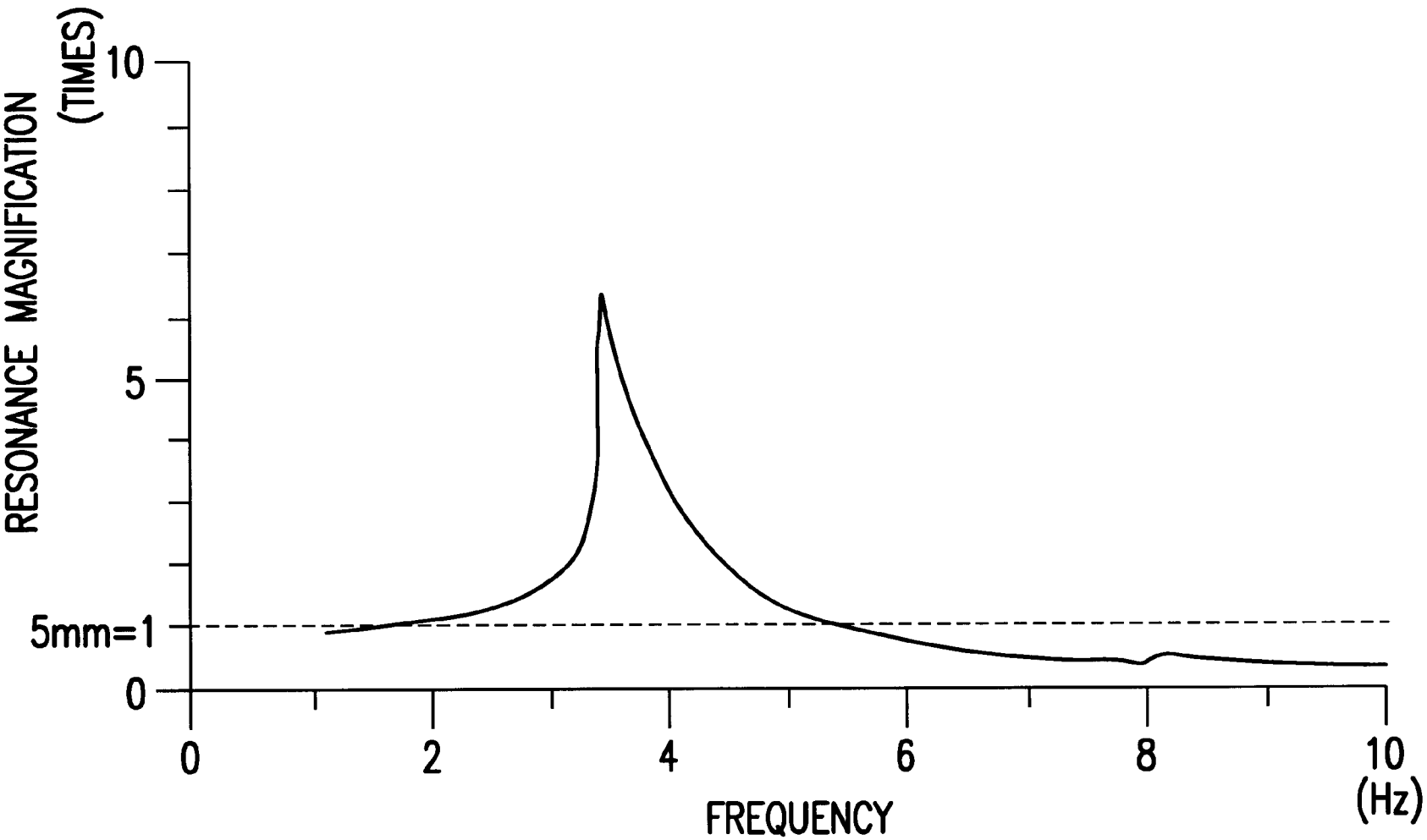
FIG. 9 is a graphical representation showing the result of the vibration characteristics test of the cushion pad of Comparative Example 1.

A forcible vibration test was applied to the cushion pads obtained in Example 1 and Comparative Example 1 using a seat cushion vibration test machine, Type C-1002DL, manufactured by Ito Seild K. K., under the following conditions. The results are shown in FIG. 8 and FIG. 9.

Pressure plate: JM50 hip type

Load: 50 kg (490 N)

Amplitude: ±2.5 mm

Frequency: 1 to 10 Hz

From these results, it can be seen that in the cushion pad of Example 1, the decay is slow, and the resonance magnification is small as compared with the cushion pad of Comparative Example 1. Also, these results mean that in the cushion pad of Example 1, the shaking feeling at the actual time of driving is small, and the cushion pad significantly reduces the occurrence of a tired feeling.

According to the present invention, a cushion pad which is comfortable to sit on because the surface gives a soft feeling and which reduces the occurrence of a tired feeling is obtained.

Furthermore, because the cushion pad of the present invention does not need a double layer structure by forming a slab layer, there are merits that the cushion pad is low in cost and has a large freedom of design.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A seat cushion pad for automobiles, comprising:

a seat surface portion, at least a part of the seat surface portion comprising a high-resilience foam; and the seat surface portion having a 3%ISR value of at least about 6, said 3%ISR value being determined from the equation:

$$3\%ISR=25\%\text{-strain load}/3\%\text{-strain load}$$

wherein the 25%-strain load is a load at which a thickness of said seat surface portion is 25% compressed when pressed by a pressure plate having a diameter of 60 mm, and the 3%-strain load is another load at which the thickness is 3% compressed when pressed with said pressure plate.

2. A seat cushion pad for automobiles according to claim 1, wherein the high-resilience foam is a polyurethane foam and is prepared with an isocyanate containing diphenylmethane diisocyanate as a main constituent.

3. A seat cushion pad for automobiles according to claim 1, wherein the high-resilience foam is a polyurethane foam and is prepared with an isocyanate containing diphenylmethane diisocyanate as a main constituent and containing tolylene diisocyanate in a ratio of less than 10%.

4. A seat cushion pad for automobiles according to claim 1, wherein said seat surface portion of the seat cushion pad includes hanging grooves formed therein in a gravity direction when said seat surface portion is in a fitted state, said hanging grooves being arranged at an angle to a surface of said seat surface portion.

5. A seat cushion pad for automobiles, comprising:

a seat surface portion, at least a part of the seat surface portion comprising a high-resilience foam: and the seat surface portion having a 5%ISR value of at least about 4, said 5%ISR value being determined from the equation:

$$5\%ISR=25\%\text{-strain load}/5\%\text{-strain load}$$

wherein the 25%-strain load is a load at which a thickness of said seat surface portion is 25% compressed when pressed by a pressure plate having a diameter of 60 mm, and the 5%-strain load is another load at which the thickness is 5% compressed when pressed with said pressure plate.

6. A seat cushion pad for automobiles according to claim 5, wherein the high-resilience foam is a polyurethane foam and is prepared with an isocyanate containing diphenylmethane diisocyanate as a main constituent.

7. A seat cushion pad for automobiles according to claim 5, wherein the high-resilience foam is a polyurethane foam and is prepared with an isocyanate containing diphenylmethane diisocyanate as a main constituent and containing tolylene diisocyanate in a ratio of less than 10%.

8. A seat cushion pad for automobiles according to claim 5, wherein said seat surface portion of the seat cushion pad includes hanging grooves formed therein in a gravity direction when said seat surface portion is in a fitted state, said hanging grooves being arranged at an angle to a surface of said seat surface portion.

* * * * *